United States Patent [19]

Tyson

[11] 4,106,840

[45] Aug. 15, 1978

[54] TUBE TERMINAL CONNECTOR ASSEMBLY

[75] Inventor: Charles H. Tyson, Lansdale, Pa.

[73] Assignee: Raytheon Company, Lexington, Mass.

[21] Appl. No.: 813,039

[22] Filed: Jul. 5, 1977

[51] Int. Cl.[2] ..... H01J 5/50

[52] U.S. Cl. ..... 339/145 R; 313/318; 339/144 T

[58] Field of Search ..... 339/17 D, 144, 145; 313/318

[56] References Cited

U.S. PATENT DOCUMENTS

| | | | |
|---|---|---|---|
| 2,524,939 | 10/1950 | Stephan et al. | 339/17 D |
| 2,894,240 | 7/1959 | Mautner | 339/17 D |
| 3,082,350 | 3/1963 | Gulbrandsen | 339/145 T X |

*Primary Examiner*—Roy Lake
*Assistant Examiner*—E. F. Desmond
*Attorney, Agent, or Firm*—J. T. Meaney; J. D. Pannone; H. A. Murphy

[57] ABSTRACT

An electron tube connector assembly including a printed circuit disc having aperture means for engaging a plurality of terminal members of an electron tube, and having printed circuit conductor means for electrically connecting at least one of the terminal members to a wire lead external of the tube.

11 Claims, 6 Drawing Figures

FIG. 2
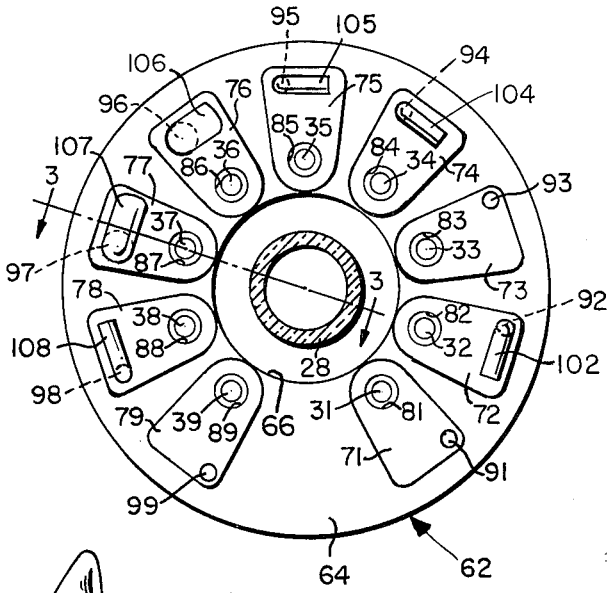
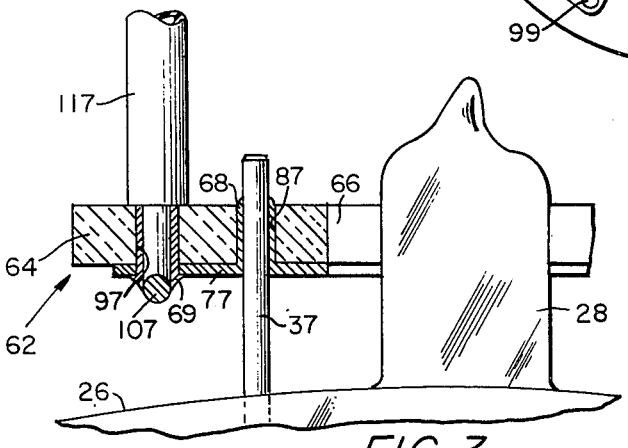
FIG. 3
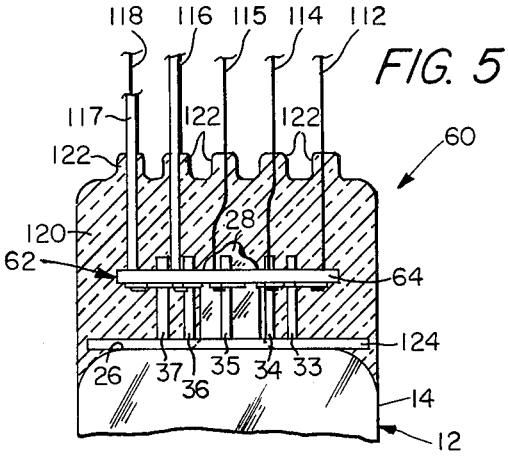
FIG. 5
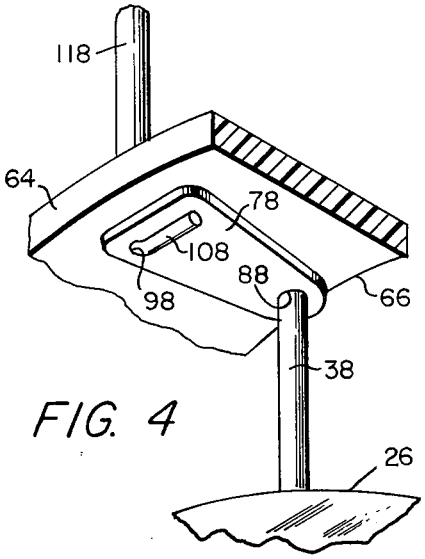
FIG. 4
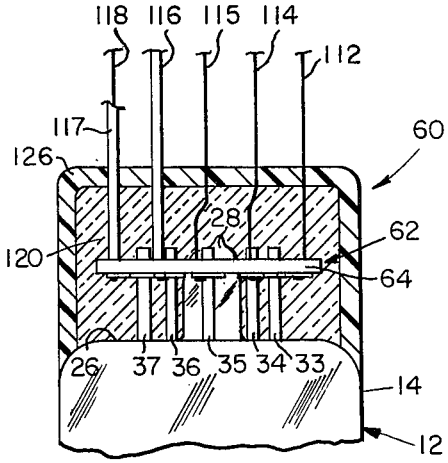
FIG. 6

TUBE TERMINAL CONNECTOR ASSEMBLY

BACKGROUND OF THE INVENTION

1. Field of the Invention

This invention relates generally to electron tube terminal connectors and is concerned more particularly with a connector assembly having printed circuit means for electrically connecting electron tube terminals to external wire leads in a space controlled manner.

2. Discussion of the Prior Art

An electron tube generally comprises an evacuated tubular envelope having therein a plurality of insulatingly spaced electrodes, and sealed at one end by a vitreous stem. Extended hermetically through the stem may be an array of closely spaced terminal pins having inner end portions electrically connected to associated electrodes of the tube. Accordingly, external end portions of the pins may be connected through respective wire leads to suitable voltage sources for maintaining the electrodes at desired electrical potentials during operation of the tube.

In order to provide reliable electrical connections, particularly in severe environments, the wire leads may have respective stripped end portions fixedly attached, as by soldering, for example, to the terminal pins. However, with this type of direct electrical connection, it is difficult to maintain sufficient insulating space between respective stripped end portions of wire leads connected to adjacent terminals of the tube. Also, some of the fixedly attached wire leads may be heavily insulated and act as respective levers when subjected to conditions of high mechanical stress, such as shock and vibration, for examples. Consequently, the heavily insulated wire leads may bend the attached terminal pins and possibly fracture the supporting vitreous stem of the tube. As a result, voltage breakdown or arc-over may occur between adjacent conductive elements within the tube envelope.

Therefore, it is advantageous and desirable to provide an electron tube with a connector assembly having means for fixedly connecting external wire leads to terminals of the tube in a spaced controlled manner, and for restricting forces transmitted from the wire leads to the terminal pins.

SUMMARY OF THE INVENTION

Accordingly, this invention provides a tube connector assembly including an electron tube comprised of an evacuated envelope having a plurality of externally protruding terminals, and printed circuit means mounted on the terminals for electrically connecting wire leads thereto. The printed circuit means comprises a dielectric disc having therein a plurality of apertures spaced predetermined distances apart, and supporting printed circuit conductor means for interconnecting at least two of the apertures. The two interconnected apertures are disposed for guiding a terminal of the tube and a conductive portion of a wire lead, respectively, into electrical engagement with the printed circuit conductor means. Thus, the interconnected apertures may function as conduit means for electrically connecting the wire lead through the printed circuit conductor means to the terminal of the tube. As a result, forces applied through the wire lead are limited by the associated conduit means and are transmitted to the printed circuit means rather than directly to the electrically connected terminal of the tube, as may occur in terminal connector assemblies of the prior art.

The disc may be provided with a first array of apertures having disposed therein respectively aligned terminals of the tube, and with a second array of apertures which are spaced predetermined distances from apertures of the first array and have disposed therein conductive portions of respective wire leads. Preferably, apertures in the first and second arrays are provided with respective conductive wall surface means, as by plating or by securing feedthrough eyelets therein, for examples, for electrically coupling to the printed circuit means. The printed circuit means may comprise a predetermined arrangement of mutually spaced conductive pads fixedly secured to the disc and extended between respective apertures of the first and second arrays. Thus, each of the conductive pads has respective portions thereof disposed for fixed attachment, as by soldering, for example, to a terminal of the tube and to a conductive portion of a wire lead. The resulting unitized structure formed by the envelope of the tube, the externally protruding terminals, and the fixedly attached disc aids the individual terminals in resisting forces transmitted from the attached wire leads to the printed circuit disc. Accordingly, the described connector assembly provides reliable means for maintaining the terminals of the tube in predetermined spaced relationship with one another and electrically connected to the wire leads, even under conditions of high stress, such as mechanical shock and vibration, for examples.

A preferred embodiment of the invention comprises an electron tube of the cathode ray type, such as a display tube, for example, having an evacuated tubular envelope provided with a neck end portion wherein aligned electrodes of an electron gun are axially disposed. The neck end portion terminates in an annular array of spaced terminal pins having inner end portions electrically connected to associated electrodes of the gun and outer end portions supporting a printed circuit disc in spaced relationship with the adjacent end of the envelope. The disc comprises a dielectric substrate having extended through its thickness a first annular array of spaced apertures wherein respectively aligned terminal pins of the tube are axially disposed. Secured to a flat surface of the substrate is an annular array of spaced conductive pads which extend radially outward from respective apertures of the first annular array to respective aligned apertures of a second annular array extended through the thickness of the substrate. Preferably, the apertures of the first and second arrays are provided with respective conductive wall surfaces, as by plating or by feed-through eyelets, for examples, which are electrically coupled to the radially aligned conductive pads.

Axially disposed in selected apertures of the second array are respective stripped end portions of insulated wire leads which extend externally of the connector assembly. The respective terminal pins and the stripped end portions are fixedly secured in the engaged aperture and electrically attached to the radially aligned conductor pads by suitable means, such as soldering, for example. The resulting cage structure formed by the adjacent end of the tube envelope, the annularly spaced terminal pins protruding therefrom, and the fixedly attached disc strengthens the individual terminal pins to resist bending forces transmitted through the attached wire leads to the printed circuit disc. The cage structure may be potted with high dielectric material, such as silicon rubber, for example, to provide greater insulating characteristics for minimizing the possibility of voltage breakdown occuring in severe environments, such as salt spray tests, for example.

BRIEF DESCRIPTION OF THE DRAWINGS

For a better understanding of this invention, reference is made in the following detailed description to the drawings wherein:

FIG. 2 is a cross-sectional view taken along the line 2—2 in FIG. 1 and looking in the direction of the arrows;

FIG. 3 is an enlarged fragmentary axial view, partly in section, taken along the line 3—3 in FIG. 2 and looking in the direction of the arrows.

FIG. 4 is an enlarged fragmentary isometric view illustrating one of the electrical connections provided by the electrical connector assembly shown in FIG. 1;

FIG. 5 is a fragmentary elevational view, partly in section, showing a potted embodiment of the invention; and FIG. 6 is a fragmentary elevational view, partly in section, showing an alternative potted embodiment of the invention.

DESCRIPTION OF THE PREFERRED EMBODIMENT

Figure 1:
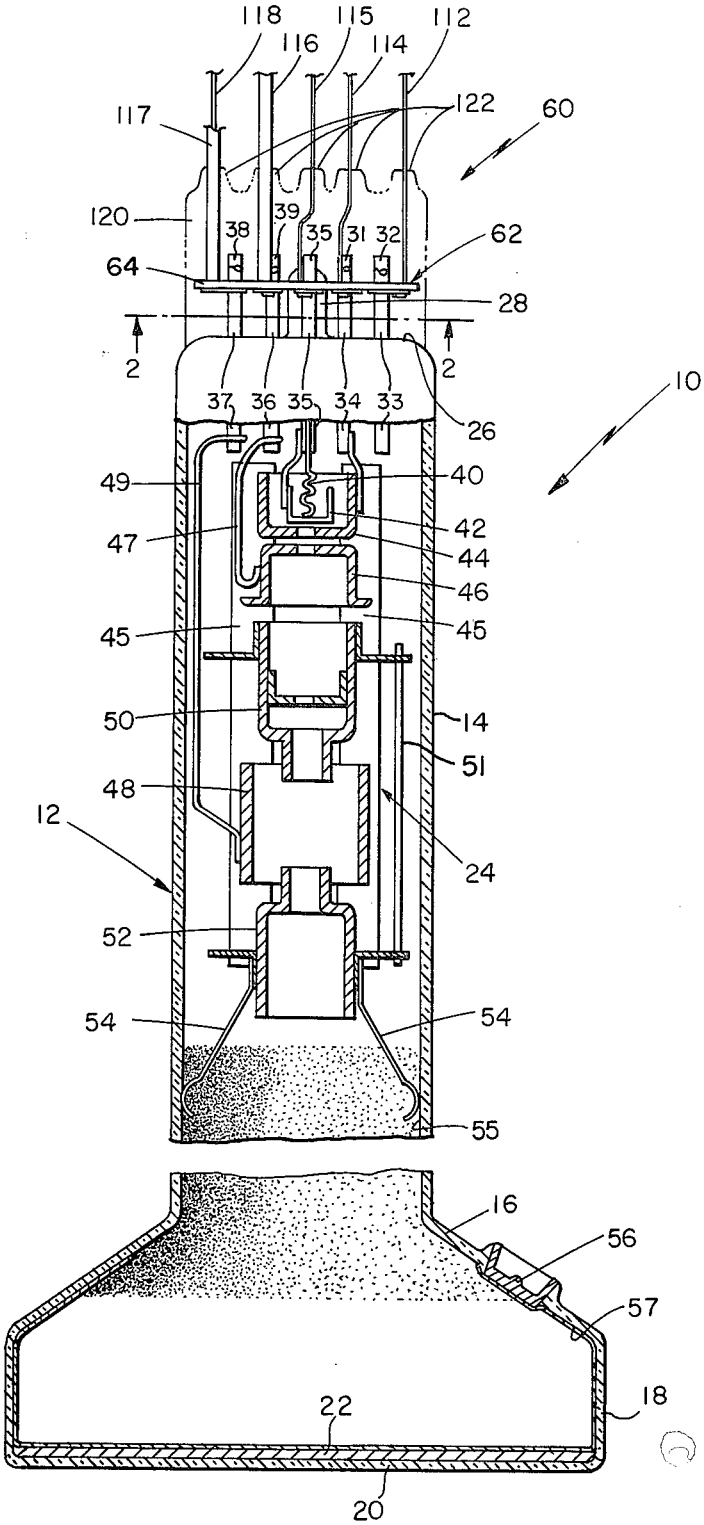
FIG. 1 is a longitudinal view, partly in section, of an electron tube and connector assembly embodying the invention.

Referring to the drawings wherein like characters of reference designate like parts, there is shown in FIG. 1 an electron tube 10 of the cathode ray type, such as a display tube, for example. Tube 10 includes an evacuated tubular envelope 12, which may be made of dielectric vitreous material, such as glass, for example. The envelope 12, preferably, has a neck end portion 14 integrally joined through an outwardly flared, intermediate portion 16 to an opposed, larger diameter end portion 18. End portion 18 terminates in a peripherally sealed end plate 20 having disposed on its inner surface an anode target comprising imaging screen layer 22 which is made of suitable fluorescent material, such as zinc sulfide, for example. The layer 22 fluoresces locally when successive discrete areas thereof are scanned, in a well-known manner, by a high energy electron beam emanating from an electron gun 24 axially disposed in neck end portion 14 of envelope 12. The neck end portion 14 terminates in a peripherally sealed stem press 26 having centrally disposed therein an exhaust tubulation 28 which is sealed-off, by well-known means, when evacuation of envelope 12 is completed.

Extending axially and hermetically through the stem press 26, as shown more clearly in FIG. 2, is an annular array of spaced terminal pins, 31–39, respectively, which have inner end portions electrically connected to associated electrodes of the electron gun 24. Inner end portions of pins 32 and 38, for example, may be electrically connected to respective terminal end portions of an electrically heated filament 40 which is disposed adjacent the stem press 26. The filament 40 is supported axially within an indirectly heated cathode cup 42 which may be electrically connected to the inner end portion of terminal pin 35, for example. Cathode cup 42 is supported axially and insulatingly within a first grid cup 44 having an apertured closed end aligned with an electron emitting end surface of cathode cup 42. For purposes of support as well as external electrical connections, the first grid cup 44 may be electrically connected to inner end portions of terminal pins 31, 34, and 39, respectively. The first grid cup 44 is radially attached, in a well-known manner, to an annular array of spaced dielectric posts 45 (only two being shown), which extend axially within neck end portion 14 to support other electrodes of gun 24 in axial alignment with first grid cup 44.

Insulatingly, spaced from the apertured closed end of first grid cup 44 is an apertured closed end of a second grid cup 46. The second grid cup 46 is electrically connected through a welded conductive strip 47 to the inner end portion of terminal pin 36, for example. The three succeeding electrodes of gun 24 constitute a well-known Einzel lense comprising a focusing sleeve electrode 48 interposed axially between first and second accelerating electrodes 50 and 52, respectively. Focusing electrode 48 is electrically connected through a welded conductive strip 49 to the inner end portion of terminal pin 37, for example. The first and second accelerating electrodes 50 and 52 are electrically connected to one another through a welded conductive strip 51, and have respective reduced diameter end portions protruding insulatingly within adjacent open end portions of the focusing sleeve electrode 48.

The opposing end portion of second accelerating electrode 52 has fixedly attached thereto, as by welding, for example, respective end portions of resilient conductive arms 54 which extend radially outward therefrom. The arms 54 electrically connect to a coating 55 of conductive material, such as graphite, for example, which is deposited, by well-known means, on the encircling inner surface of neck end portion 14. The conductive coating 55 extends axially and annularly onto the inner surface of intermediate portion 16, and is electrically connected to a button-type terminal 56 which extends hermetically through the envelope 12. The terminal 56 also is electrically connected to a coating 57 of conductive material, such as aluminum, for example, which is deposited, by well-known means, annularly onto the inner surface of intermediate portion 16 adjacent the larger diameter portion 18. The coating 57 extends axially and annularly onto the inner surface of larger diameter portion 18 and overlays the inner surface of imaging screen layer 22.

In operation, an electrical current is passed through the filament 40 to heat the cathode cup 42 to a suitable electron emitting temperature. The other electrodes of gun 24 function as beam forming means for directing electrons emitted from cathode cup 42 into a beam and focusing them onto a discrete area of the imaging layer 22. Accordingly, the button-type terminal serves as external connecting means for maintaining respective conductive coatings 57 and 55, and respective accelerating electrodes 50 and 52 of gun 24 at a suitable electrical potential, such as 10,000 to 15,000 volts, for example, with respect to the potential of cathode cup 42. Similarly, the terminal pins 37 and 36 provide respective external connecting means for maintaining the focusing electrode 48 and the second grid electrode 46 of gun 24 at suitable electrical potentials, such as 500 to 800 volts and 300 to 500 volts, respectively, for example, with respect to the potential of cathode cup 42. Also, the terminal pin 35 provides external connecting means for maintaining the cathode cup 42 at a desired electrical potential, such as zero volts or electrical ground, for examples. The terminal pin 34, for example, provides external connecting means for applying to the first grid electrode 44 voltages, such as negative 10 to 70 volts, for examples, with respect to the cathode cup 42.

Thus, the focusing electrode 48 and the second grid electrode 46 connected to respective terminal pins 37 and 36 are maintained at relatively high electrical potentials as compared to first grid electrode 44, cathode cup 42, and filament 40, which are connected to the other terminal pins of tube 10. Consequently, for greater reliability, the wire leads connected to outer end portions of the terminal pins 37 and 36 may be more heavily insulated than the wire leads connected to outer end portions of the other terminal pins of tube 10. Furthermore, to insure against open circuit failures occuring under high stress operating conditions, the wire leads may be attached directly to the terminal pins. However, during mechanical shock and vibration, for examples, the heavier insulated wire leads may act as respective levers to cause bending of the attached terminal pins and possible fracture of the vitreous stem press 26. Therefore, in order to avoid the undesirable effects of the heavier insulated wire leads, tube 10 is provided with a terminal connector assembly 60 including a printed circuit means 62 mounted on the outer end portions of terminal pins 31–39, respectively.

As shown more clearly in FIGS. 2–4, the printed circuit means 62 comprises a substrate disc 64 made of dielectric material, such as fiberglass reenforced epoxy, for example. The disc 64 is disposed in spaced axial alignment with the stem press 26 and is provided with a central aperture 66 through which extends the exhaust tubulation 28 of tube 10. The surface of disc 64 adjacent the stem press 26 has fixedly secured thereto, as by conventional printed circuit techniques, for example, an annular array of spaced pads 71–79, respectively. The pads 71–79 are made of electrically conductive material, such as tin-plated copper, for example, and extend radially outward from adjacent the periphery of central aperture 66 to terminate adjacent the outer periphery of disc 64. Radially aligned with each of the pads 71–79 is a respective aperture 81–89 which extends axially through the inner end portion of the pad and through the thickness of disc 64. The apertures 81–89 constitute an annular array of spaced apertures disposed adjacent the periphery of central aperture 66, and have axially inserted therein respective aligned terminal pins 31–39 of tube 10.

The limited spacing between adjacent terminal pins 31–39, respectively, and the correspondingly limited surface areas provided by the encircling inner end portions of the conductive pads 71–79, respectively, illustrate the problem of connecting conductive portions of wire leads to the terminal pins in an insulatingly spaced manner. However, this problem is solved by providing each of the conductive pads 71–79 with an angular wedge shape or tapering width configuration. Consequently, adjacent the stem press 26, the conductive pads 71–79 have respective surfaces which increase in angular width as a function of increasing radial distance from the aligned apertures 81–89, respectively. As a result, each of the pads 71–79 terminates in an outer end portion having a width sufficiently greater than its inner end portion to permit attaching a conductive portion of a wire lead thereto in a spaced controlled manner. Accordingly, there is disposed adjacent the outer periphery of disc 64 an outer annular array of spaced apertures 91–99, respectively, each of which extends axially through an outer end portion of a respective pad 71–79 and through the thickness of disc 64. Thus, each of pads 71–79 provides a conductive path connecting a respective aperture 81–89 in the inner array with a respective aperture 91–99 in the outer array.

Each of the apertures 81–89 and 91–99 may be provided with a respective electrically conductive wall surface, as by electrodeless copper plating, for example, which is electrically coupled to the associated conductive pad 71–79, respectively. Alternatively, each of the apertures 81–89 and 91–99 may have axially disposed therein an electrically conductive eyelet (not shown) having a flanged end portion electrically coupled to the associated conductive pad 71–79, respectively. Thus, the apertures 81–89 and 91–99 constitute respective conduit means for bringing axially inserted conductive members, such as terminal pins 31–39, for example, into electrical engagement with the electrically coupled conductive pads 71–79, respectively. The terminal pins 31–39 are fixedly attached in an electrically conductive manner, as by solder 68, for example, to the electrically conductive wall surfaces of respective apertures 81–89 and to the encircling portions of conductive pads 71–79, respectively.

Stripped end portions 102, 104, 105, 106, 107, and 108 of insulated wire leads 112, 114, 115, 116, 117, and 118, respecively, are inserted axially through apertures 92, 94, 95, 96, 97, and 98, respectively, and are bent to lie entirely over adjacent surface portions of the conductive pads 72, 74, 75, 76, 77, and 78, respectively. If necessary, the stripped end portions 102 and 104–108 may be cut to respective lengths which do not protrude beyond the edges of the associated conductive pads 72 and 74–78, respectively, and may be bent in any desired fashion to overlie predetermined surface areas of the respectively associated conductive pads. The stripped end portions 102 and 104–108 are fixedly attached in an electrically conductive manner, as by solder 69, for example, to the electrically conductive wall surfaces of apertures 92 and 94–98, respectively, and to the adjacent surface areas of conductive pads 72 and 74–78, respectively. As a result, the insulated wire leads 112 and 118 are electrically connected through conductive pads 72 and 78, respectively, to terminal pins 32 and 38, respectively, which are connected to respective end portions of the filament 40 within envelope 12. Similarly, the insulated wire leads 114 and 115 are electrically connected through respective pads 74 and 75 to respective terminal pins 34 and 35, which are connected to the first grid electrode 44 and the cathode cup electrode 42, respectively, within envelope 12. Also, the respective wire leads 116 and 117, which are more heavily insulated than the other wire leads, are electrically connected through respective pads 76 and 77, to respective terminal pins 36 and 37, which are connected to the second grid electrode 46 and the focusing electrode 48, respectively, within envelope 12.

Thus, it may be seen that an axial pulling force applied to any of the wire leads 112 and 114–118 is transmitted to the bent end portions 102 and 104–108, respectively, thereof which are fixedly attached to respective pads 72 and 74–78 secured to the disc 64. As a result, axial pulling forces applied to the wire leads 112 and 114–118, respectively, are not transmitted to individual terminal pins 31–39 of tube 10. Similarly, laterally directed forces applied to any of the wire leads 112 and 114–118, respectively, are transformed by the associated conduit means comprising apertures 92 and 94–98, respectively, into axially directed forces, which are not transmitted to the individual terminal pins 31–39 of tube 10. Also, the stem press 26, the protruding annular array of terminal pins 31–39, respectively, and the fixedly attached disc 64 constitute a cage-like structure which resists forces transmitted simultaneously through all the wire leads 112 and 114–118 to the disc 64. Accordingly, the terminal connector assembly 60 provides printed circuit means 62 for connecting wire leads to the respective terminal pins 31–39 of tube 10 in a spaced controlled manner which avoids bending the pins and possibly fracturing the envelope, particularly when the tube 10 is subjected to high stress operating conditions, such as mechanical shock and vibration, for examples.

The cage-like structure formed by stem press 26, respective terminal pins 31–39, and printed circuit means 62 may be enclosed within a high dielectric encapsulating material 120, which preferably has resilient properties, such as silicon rubber, for example. The wire leads 112 and 114–118, respectively, may emerge from the encapsulant 120 through strain relieving fillets 122, each of which encircles a respective wire lead and flexes when the wire lead is flexed. As shown in FIG. 5, the encapsulated connector assembly 60 may include a pressure absorbing foam rubber pad 124 which is forced over outer end portions of the terminal pins 31–39 and urged against the exterior surface of stem press 26 prior to encapsulation. The rubber pad 124 provides means for compensating for expansive pressures which may develop in the encapsulant 120 during curing.

Alternatively, as shown in FIG. 6, the cage-like structure formed by stem press 26, respective terminal pins 31–39, and printed circuit means 62 may be enclosed within a cup-shaped shell 126 made of molded dielectric material, such as a polycarbonate material, for example. The shell 126 has an open end provided with a circular rim which is suitably secured, as by adhesive material, for example, to the outer marginal portion of stem press 26. The opposing open end of shell 126 may be provided with an opening (not shown) through which the encapsulating material 120 is injected to completely fill the shell. Thus, the connector assembly 60 is provided with dielectric encapsulating means for protecting elements of the assembly in adverse environments, such as salt spray tests, for example.

From the foregoing, it will be apparent that all of the objectives of this invention have been achieved by the structures shown and described herein. It also will be apparent, however, that various changes may be made by those skilled in the art without departing from the spirit of the invention as expressed in the appended claims. It is to be understood that all matter shown and described herein is to be interpreted in an illustrative rather than in a restrictive sense.

What is claimed is:

1. An electron tube terminal connector assembly comprised of:

an electron tube including an evacuated envelope;

a plurality of spaced terminal members sealed into the envelope and having respective outer portions extended outwardly therefrom;

printed circuit means mounted on respective outer portions of the terminal members for restricting forces applied to the terminal members, and including a dielectric substrate provided with electrical conduit means permanently connected mechanically and electrically to respective outer portions of the terminal members for making selective electrical connections to the terminal members in a spaced controlled manner; and wire conductor means permanently connected mechanically and electrically to the electrical conduit means for making external electrical connections to selected terminal members of the tube.

2. An electron tube terminal connector assembly as set forth in claim 1 wherein the electrical conduit means includes a first array of spaced apertures disposed in the dielectric substrate and having electrically conductive wall surfaces permanently attached mechanically and electrically to respective outer portions of the terminal members.

3. An electron tube terminal connector assembly as set forth in claim 2 wherein the electrical conduit means includes a plurality of printed circuit conductors fixedly secured to the dielectric substrate in predetermined spaced relationship with one another and permanently connected mechanically and electrically to conductive wall surfaces of respective apertures in the first array; and a second array of spaced apertures disposed in the dielectric substrate in spaced relationship with the apertures of the first array and having conductive wall surfaces permanently connected mechanically and electrically to a respective printed circuit conductor.

4. An electron tube terminal connector assembly as set forth in claim 3 wherein the wire conductor means includes a plurality of wire conductors permanently attached mechanically and electrically to the conductive wall surfaces of respective apertures in the second array.

5. An electron tube terminal connector assembly as set forth in claim 1 wherein the terminal members comprise an annular array of spaced terminal pins having respective outer portions extended outwardly from the envelope.

6. An electron tube terminal connector assembly as set forth in claim 5 wherein the printed circuit means comprises a dielectric disc provided with electrical conduit means including a first annular array of spaced apertures extended through the thickness of the disc, each of the apertures in the first array having axially disposed therein an outer end portion of a respective terminal pin and having electrically conductive wall surfaces permanently secured mechanically and electrically thereto.

7. An electron tube terminal connector assembly as set forth in claim 6 wherein the disc is axially spaced from the envelope and constitutes one end of a cage-like structure formed by the annular array of spaced terminals and the adjacent portion of the envelope.

8. An electron tube terminal connector assembly as set forth in claim 6 wherein the electrical conduit means includes an annular array of electrically conductive pads fixedly secured in predetermined spaced relationship with one another to a flat surface of the disc, each of the pads having a radially inner end portion permanently connected mechanically and electrically to the electrically conductive wall surface of a respective aperture of the first array and a radially aligned outer end portion disposed adjacent the outer periphery of the disc.

9. An electron tube terminal connector assembly as set forth in claim 8 wherein each of the conductive pads is provided with an angularly tapering width which increases with increasing radial distance from the aligned aperture in the first array.

10. An electron tube terminal connector assembly as set forth in claim 8 wherein the electrical conduit means includes a second annular array of spaced apertures disposed adjacent the outer periphery of the disc extended through the thickness thereof, each of the apertures in the second array having conductive wall surfaces permanently connected mechanically and electrically to an outer end portion of a respective conductive pad.

11. An electron tube terminal connector assembly as set forth in claim 8 wherein the wire conductor means includes a plurality of wire conductors permanently attached mechanically and electrically to the conductive wall surfaces of respective selected apertures in the second array.

* * * * *